US006494735B1

(12) United States Patent
Chen et al.

(10) Patent No.: US 6,494,735 B1
(45) Date of Patent: Dec. 17, 2002

(54) COMPUTER INPUT/OUTPUT CABLE PLUG RETAINING SEAT

(75) Inventors: Jui-Hung Chen, Taipei; Hsien-Chien Li; Chi-Wen Chen, both of Sanchung, all of (TW)

(73) Assignee: Comtrend Corporation, Taipei Hsien (TW)

( * ) Notice: Subject to any disclaimer, the term of this patent is extended or adjusted under 35 U.S.C. 154(b) by 0 days.

(21) Appl. No.: 09/878,299

(22) Filed: Jun. 12, 2001

(51) Int. Cl.[7] ..... H01R 13/64
(52) U.S. Cl. ..... 439/378; 439/359; 439/565
(58) Field of Search ..... 439/378, 367, 439/362, 359, 544, 564, 565, 373, 371

(56) References Cited

U.S. PATENT DOCUMENTS 2,938,188 A * 5/1960 Lazzery ..... 439/544
4,437,717 A * 3/1984 Korzik et al. ..... 439/64
5,011,427 A * 4/1991 Martin ..... 439/373
5,234,348 A * 8/1993 Konsevich et al. ..... 439/61
5,409,394 A * 4/1995 Astier ..... 439/373
5,513,995 A * 5/1996 Kurotori et al. ..... 439/377
5,813,867 A * 9/1998 Hodge ..... 439/581
5,876,233 A * 3/1999 Chourdhury et al. ..... 439/368
5,885,088 A * 3/1999 Brennan et al. ..... 439/378
5,928,023 A * 7/1999 Buckner et al. ..... 439/373

* cited by examiner

*Primary Examiner*—Gary F. Paumen
*Assistant Examiner*—Felix D. Figueroa
(74) *Attorney, Agent, or Firm*—Rosenberg, Klein & Lee

(57) ABSTRACT

A computer input/output (I/O) cable plug retaining seat comprises a retaining cover and a base. The seat can be connected to a computer I/O plug, such as a well-known CENTRONICS cable plug. Four screws are used to secure the cable plug between the retaining cover and the base. A pair of fixing screws secure the retaining seat with cable plug to the rear cover of an equipment shelf so that when a channel unit slides from the card guide of the equipment shelf, the channel unit connector will be led into the guide holes by means of guide pins so that the channel unit connector is precisely aligned with the cable plug. When a user wishes to remove the channel unit from the equipment shelf, the channel unit is extracted directly without having to disconnect the cable. Thus, the objective of rapid assembly and disassembly is achieved.

3 Claims, 3 Drawing Sheets

COMPUTER INPUT/OUTPUT CABLE PLUG RETAINING SEAT

FIELD OF THE INVENTION

The present invention relates to a computer input/output (I/O) cable plug retaining seat for use in a computer equipment shelf system. When a channel unit of a shelf is to be changed, the channel unit can be pulled out without needing to detach the cable plug.

BACKGROUND OF THE INVENTION

In the connection of a computer I/O cable such as the well-known parallel CENTRONICS cable, a channel unit connector is pushed along the card guide of an equipment shelf and the connector of the channel unit protrudes from a slot on the rear cover of the equipment shelf so the external cable plug is directly coupled to the connector of the channel unit. Then, the screws adjacent to the cable plug are used to fix the two together so as to avoid separation. However, this prior technology has the following disadvantages:

1. When the channel unit is to be pulled out from the shelf, the screw at the backside of the shelf must be released. If it is necessary for the channel unit to be pulled out and inserted frequently, the operation is inconvenient.

2. When the connector of the cable is to be separated from the connector of the channel unit, the cable plug is not attached and is placed anywhere. When it is desired to connect the channel unit with the cable plug again, the polarities, positions and order must be identified again. The efficiency of this operation is very poor.

SUMMARY OF THE INVENTION

Accordingly, the primary object of the present invention is to provide a computer I/O cable plug retaining seat, wherein as a channel unit of an equipment shelf is desired to be updated, the channel unit can be pulled out directly, the operation of loosening or locking the screws of the cable plug is unnecessary. The operation is convenient and time is saved.

Another object of the present invention is to provide a computer I/O cable plug retaining seat wherein, by the guide holes and guide pins, the male and female connectors can be combined precisely.

To achieve the above objects, the present invention provides a computer I/O cable plug retaining seat comprising:

a retaining cover having an inverted channel shape and having an opening in a middle section thereof; an upper side thereof having four screw holes for engaging with screws; the retaining cover is used to surround a cable plug and being then locked to a base;

a base having a channel shape and having a bottom containing a square opening; an upper side thereof having two fixing screws, four spacers, and two positioning holes; the two fixing screws serving to fix the base to the rear cover of an equipment shelf; the four spacers serving for being passed through by screws so as to fix the base and retaining cover; the two guide holes serving to position the cable plug correctly when connecting the retaining cover to the base and for positioning the plug over the guide pins; and two guide pins being installed on a channel unit connector; the guide pins being inserted into the guide holes of the base so that the channel unit connector is precisely aligned with the cable plug on the retaining seat.

The various objects and advantages of the present invention will be more readily understood from the following detailed description when read in conjunction with the appended drawings.

DETAILED DESCRIPTION OF THE PREFERRED EMBODIMENTS

Figure 1:
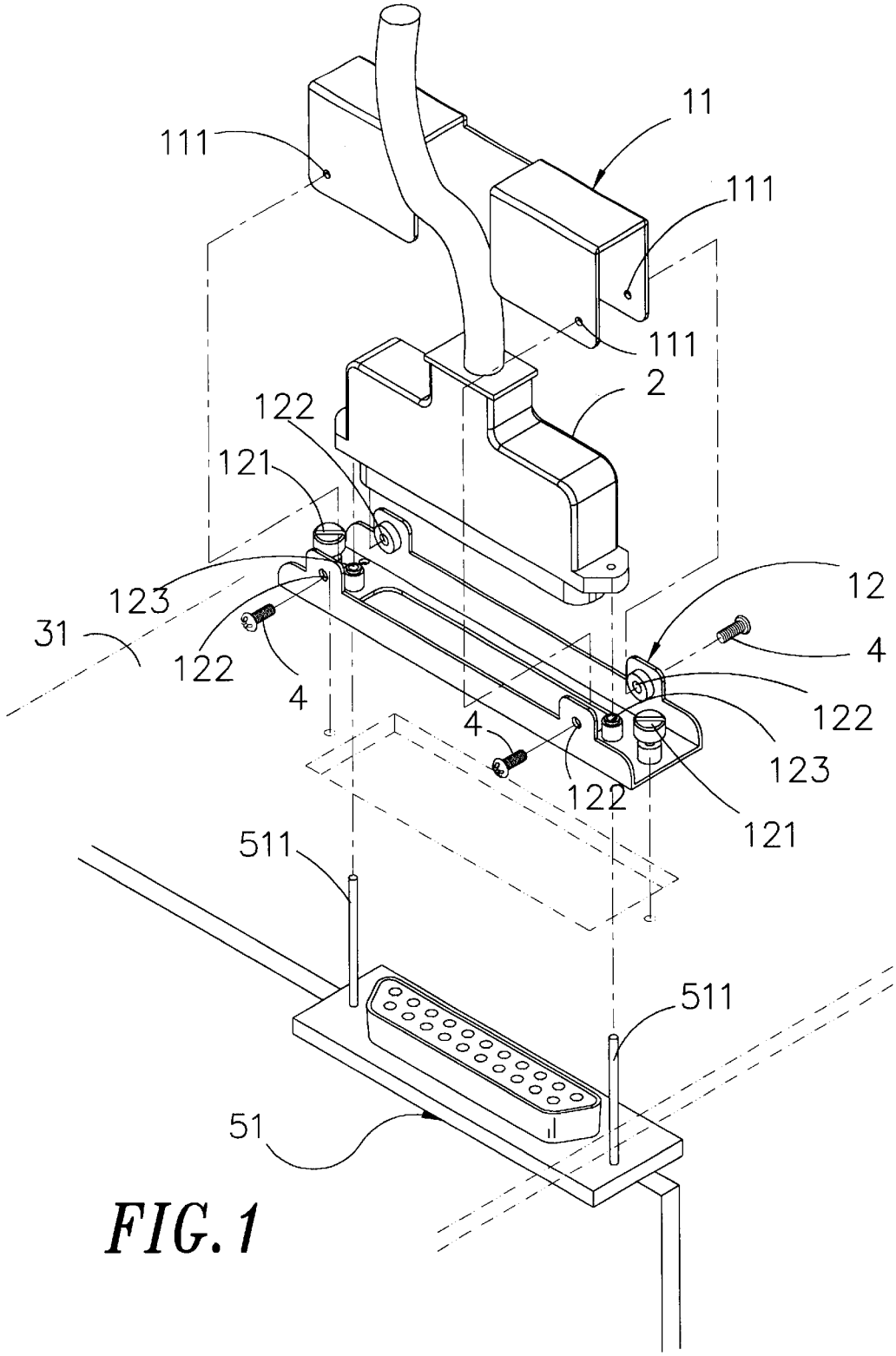
FIG. 1 is an exploded view of the computer I/O cable plug retaining seat according to the present invention.

Referring to FIG. 1, a computer I/O plug, such as the commonly known CENTRONICS cable plug combined with the retaining seat of the present invention is illustrated. The computer I/O cable plug retaining seat includes the following components:

A retaining cover 11 has an inverted channel shape and has an opening at a middle section thereof. An upper side thereof has four threaded screw holes 111 for engaging with four screws. Thus, the retaining cover 11 can be placed over the cable end of cable plug 2 and then locked to base 12.

A base 12 has a channel shape and has a bottom having a square opening. An upper side thereof has two fixing screws 121, four spacers 122, and two guide holes 123. The two fixing screws 121 serve for attaching the base 12 to the rear cover 31 of an equipment shelf. The four spacers 122 are passed through by screws 4 when attaching the base 12 and retaining cover 11. The two guide holes 123 serve to position cable plug 2 correctly when connecting the retaining cover 11 to the base 12 and for positioning the plug over the guide pins 511.

Two guide pins 511 are installed to a channel unit connector 51. The guide pins 511 are inserted into the guide holes 123 of the base 12 so that the channel unit connector 51 is precisely aligned with the cable plug 2 on the retaining seat.

Figure 2:
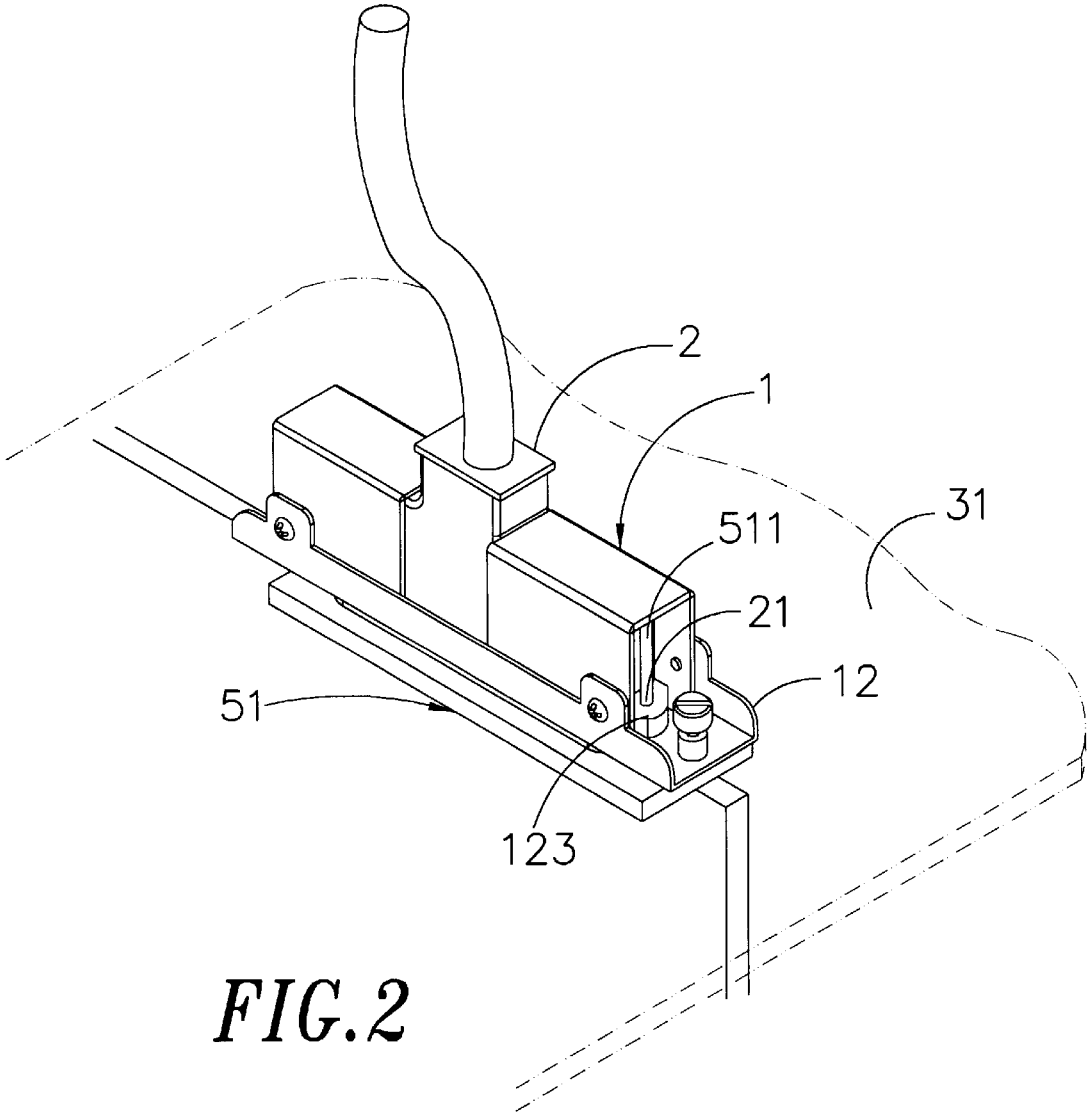
FIG. 2 is a perspective view of the computer I/O cable plug retaining seat of the present invention.

Referring to FIG. 2, a perspective view of the computer I/O cable plug retaining seat of the present invention is illustrated. It is appreciated from the drawing that in the retaining seat 1 of the present invention, the cable plug 2 is enclosed and fixed and then is locked to the rear cover 31 of the shelf. The guide pins adjacent to the channel unit connector pass through the guide holes 123 of the base 12 and the screw holes 21 at two sides of the cable plug 2 so that the channel unit connector 51 is precisely aligned with the cable plug 2.

Figure 3:
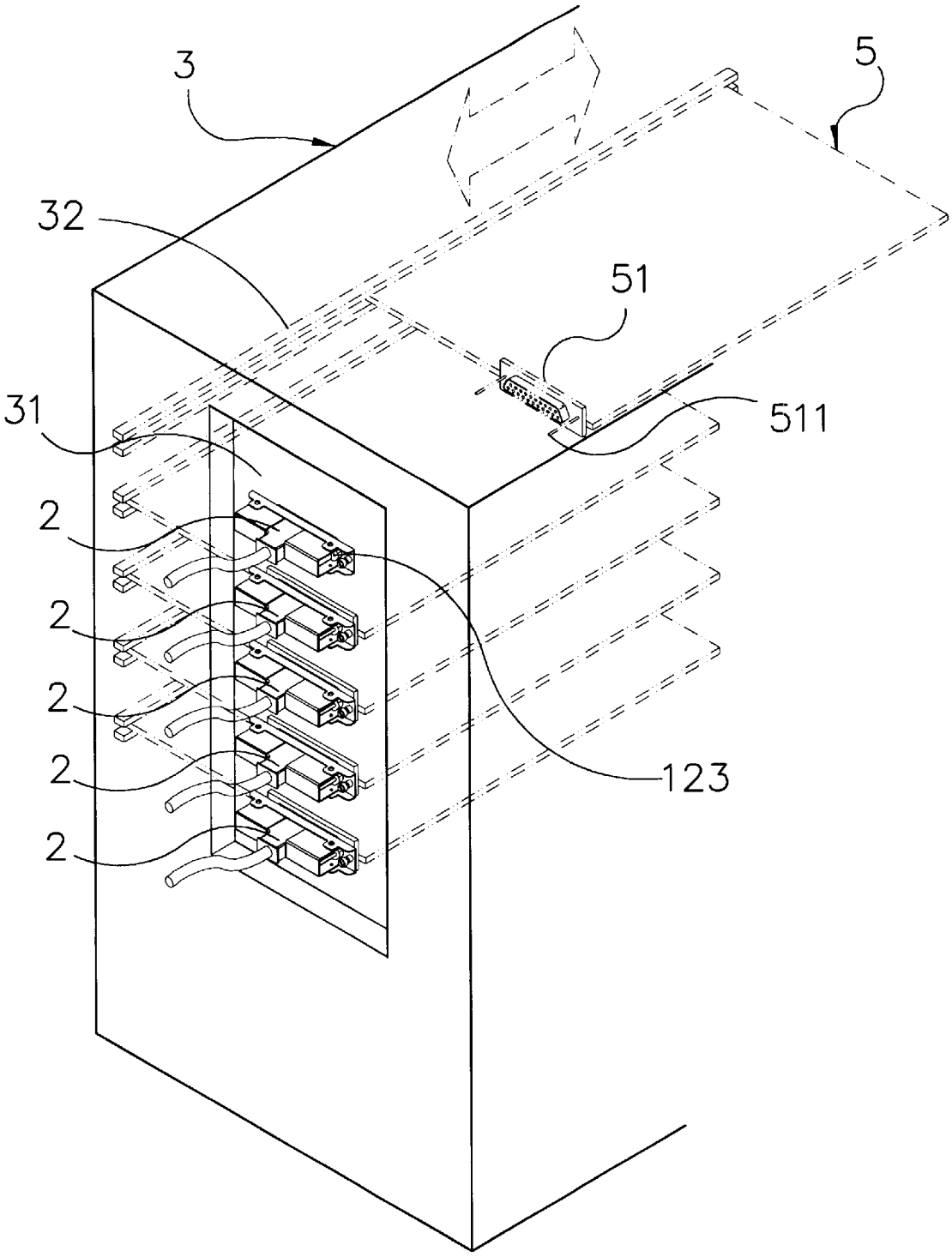
FIG. 3 is a schematic view of the computer I/O cable plug retaining seat of the present invention.

With reference to FIG. 3, a schematic view for realizing the computer I/O cable plug retaining seat of the present invention is illustrated. A plurality of cable plugs 2 can be fixed to the rear cover 31 of an equipment shelf. When channel unit 5 slides from the card guide 32 of the shelf 3, the channel unit connector 51 will guide into the guide holes 123 by the guide pins 511 so that the channel unit connector 51 may be precisely aligned with the cable plug 2. When the user desires to remove the channel unit 5 from the shelf 3, it is only necessary to extract the channel unit 5 directly.

The computer I/O cable plug retaining seat of the present invention has the following advantages over the prior technology:

1. In the computer I/O cable plug retaining seat of the present invention, when it is desired to update the channel unit of a shelf, the channel unit can be pulled out directly, the operation of loosening or locking the screws of the cable plug is unnecessary. The operation is convenient and time is saved.

2. In the computer I/O cable plug retaining seat of the present invention, by the guide holes and guide pins, the male and female connectors can be precisely aligned.

The present invention thus described, it will be obvious that the same may be varied in many ways. Such variations are not to be regarded as a departure from the spirit and scope of the present invention, and all such modifications as would be obvious to one skilled in the technology are intended to be included within the scope of the appended claims.

What is claimed is:

1. A computer input/output cable retaining seat for use in computer equipment having at least one equipment shelf containing a channel unit, said computer input/output cable retaining seat comprising:

a cable plug having formed thereon two alignment holes located at opposing ends of said cable plug, said two alignment holes being formed parallel to a direction in which said cable plug is forced into mechanical connection with a complementarily figured connector, wherein said cable plug includes a mating portion for mechanically connecting said cable plug to said complementarily configured connector;

a channel unit connector incorporating said complementarily configured connector, said channel unit connector including two guide pins, each of said guide pins aligned in position with a corresponding one of said alignment holes formed in said cable plug;

a retaining cover including two parallel sidewalls and an upper wall joining said two parallel sidewalls at an upper edge of each of said two parallel sidewalls, said two parallel sidewalls and said upper wall defining a transverse cross-sectional profile of an inverted "U", wherein said retaining cover has formed therein:

(a) an opening having an inverted "L" profile at a central portion of a longitudinal extent of said retaining cover, wherein said opening traverses one of said two parallel sidewalls and said upper wall of said retaining cover, and (b) four threaded screw holes, each of said four threaded screw holes formed along a lower edge of said two parallel sidewalls of said retaining cover;

a base including two parallel base sidewalls and a lower wall joining said two parallel base sidewalls at a lower edge of each of said two parallel base sidewalls, said two parallel base sidewalls and said lower wall defining a transverse cross-sectional profile of a "U", wherein said base includes:

(a) two fixing screws, each of said two fixing screws located at opposing ends of said base, where said fixing screws are configured to retain said base against said equipment shelf, (b) four spacers, each of said four spacers having formed therein a through-hole, wherein each of said four spacers align in position with a corresponding one of said four screw holes of said retaining cover;

(c) a square opening formed in a central portion of said lower wall, said square opening sized to allow said mating portion of said cable plug to pass therethrough, and (d) two positioning holes formed in said lower base at opposing ends of said square opening, each of said two positioning holes aligned in position with a corresponding one of said alignment holes of said cable plug while simultaneously aligned with a corresponding one of said guide pins of said channel unit connector;

wherein said cable plug is positioned between said retaining cover and said base such that said mating portion of said cable plug is located in said square opening of said base, said two alignment holes of said cable plug are registered over said corresponding positioning holes of said base and said four spacers of said base are registered over said corresponding threaded screw holes of said retaining cover, where said base and said retaining cover are secured together by passing a screw through each of said four spacers of said base and engaging said screw with said corresponding threaded screw hole of said retaining cover, and wherein said channel unit connector being mounted on said channel unit is precisely aligned with said cable plug when said channel unit is inserted into said equipment shelf, by means of said guide pins being passed through said positioning holes of said base and into said alignment holes of said cable plug, said channel unit being removable from said equipment shelf without manually disconnecting said cable plug therefrom.

2. The computer input/output cable plug retaining seat as recited in claim 1, wherein the cable plug between said retaining cover and said base incorporates a male connector.

3. The computer input/output cable plug retaining seat as recited in claim 1, wherein said cable plug between said retaining cover and said base incorporates a female connector.

* * * * *